United States Patent [19]

Ward et al.

[11] 4,252,395

[45] Feb. 24, 1981

[54] TERMINAL APPARATUS FOR INTERCONNECTING TWO OR MORE INSULATED ELECTRICAL CONDUCTORS

[75] Inventors: Ronald C. Ward; Richard B. Kosten, both of Huntsville, Ala.

[73] Assignee: GTE Automatic Electric Laboratories Inc., Northlake, Ill.

[21] Appl. No.: 476

[22] Filed: Jan. 2, 1979

[51] Int. Cl.[3] ..... H01R 9/08

[52] U.S. Cl. ..... 339/97 P

[58] Field of Search ..... 339/95 R, 95 D, 97 R, 339/97 P, 98, 266, 274

[56] References Cited

U.S. PATENT DOCUMENTS

| | | | |
|---|---|---|---|
| 964,760 | 7/1910 | Cumings | 339/274 |
| 2,602,831 | 7/1952 | Levitt | 339/97 R |
| 2,716,227 | 8/1955 | Cook | 339/274 |
| 3,070,771 | 12/1962 | Piorunneck | 339/274 |
| 3,233,206 | 2/1966 | Fiala | 339/98 |
| 3,328,747 | 6/1967 | Dover et al. | 339/274 |
| 3,403,372 | 9/1968 | Stinson, Jr. | 339/97 R |
| 4,019,801 | 4/1977 | Hoffman | 339/98 |
| 4,147,398 | 4/1979 | Lill | 339/98 |

*Primary Examiner*—Joseph H. McGlynn

*Attorney, Agent, or Firm*—Robert J. Black; Anthony Miologos

[57] ABSTRACT

Terminal apparatus comprised of an interconnecting terminal and an insulated base complementary to the terminal. The terminal includes a center section providing an electrical connection. The center section which includes slot-type termination devices is connected to an electrical conductor held within a support channel on the base, by moving the center section and the base together in a linear direction. The outer sections of the terminal are left in an angled position. In making subsequent connections to other electrical conductors held on the base, the ends of the outer sections are moved downward in a pivoting fashion. Slot-type termination devices on the outer sections engage the respective conductors.

9 Claims, 4 Drawing Figures

TERMINAL APPARATUS FOR INTERCONNECTING TWO OR MORE INSULATED ELECTRICAL CONDUCTORS

BACKGROUND OF THE INVENTION

1. Field of the Invention

This invention relates in general to devices for mechanically retaining and electrically connecting insulated electrical conductors and more particularly to a terminal apparatus for electrically interconnecting two or more insulated electrical conductors without the need of special tools.

2. Description of the Prior Art

Terminal block are apparatus which are commonly used to electrically interconnect insulated electrical conductors or wires. A terminal block typically includes a base of electrically insulating material adapted to be mounted to a structure and may include a number of threaded fasteners in threaded sockets spaced along the block, some of which may be electrically connected. A set of wires are interconnected by connecting one end of each wire to a common fastener or to one of a series of electrically connected fasteners. To make such a connection, insulation must be first stripped from the end of the wire. If the wire is solid, the stripped end may then be bent in a U-shape and hooked around a fastener, whereas if the wire is stranded a special tip in the form of an eyelet or fork is installed on the stripped end and the tip inserted under the head of the fastener. The fastener is tightened with a screwdriver to complete the connection. This connection process is tedious and requires an excessive amount of time and effort, particularly were a large number of connections must be made.

Terminal blocks are known which utilize contact elements having spaced resilient figures defining wire accepting slots to interconnect two or more small gauge wires. Such units are like those disclosed in U.S. Pat. Nos. 3,234,498, 3,239,796, 3,848,954 and 3,937,549. These devices require special tools for installing the wires to the slot-type or clip-type terminals.

U.S. Pat. No. 3,812,449 to Robert A. Elm, issued May 21, 1974, teaches a terminal strip for interconnecting separate sets of wires. This device has disadvantages in that it requires many additional loose parts namely at least three slot-type contact elements to interconnect up to four different wires together. Additionally the contact elements must be urged against the wires employing a set of pliers or other crimping tool and requires a special base which must be elevated above the mounting structure which may take up valuable space within certain types of equipment, such as telephone wall jacks and the like.

Accordingly it is the object of the present invention to provide a terminal apparatus for electrically interconnecting two or more insulated electrical conductors utilizing a single interconnecting element which can be applied without the need of special tools.

SUMMARY OF THE INVENTION

In accomplishing the object of the present invention, a terminal apparatus for electrically interconnecting two or more wires together is provided. The terminal apparatus is comprised of two elements. An electrically conductive interconnecting terminal and an insulated base complementary to the terminal.

The interconnecting terminal is generally U-shaped in cross section and includes a top surface with downwardly oriented legs perpendicular to the top surface. The terminal is further divided into three sections, including a central primary connecting section which is integrally mounted to a movable secondary connecting section by a relieved hinge section. An additional secondary connecting section and hinge section is integrally mounted to the primary section directly opposite of the first secondary connecting section. Each of the primary and secondary legs include at least one slot-type termination device and an outwardly oriented barbed portion. Each secondary section is manufactured so as to be angularly displaced upward from the primary sections horizontal plane.

The insulated base is molded complementary to the features of the interconnecting terminal and provides a support channel for the wires at the right height and location for alignment with the termination slots on the terminal legs. Receiving channels are provided for the primary connecting section and the secondary connecting sections legs and are adapted to have the barbed portions of each leg engage adjacent receiving channel walls for retension of the terminal.

The terminal is installed to the base by first placing a wire within the support channel which corresponds to the primary connecting section. The terminals primary section legs are then inserted into their respective receiving channels. The slot-type termination device of each leg engages the wire and slices through the insulation electrically connecting the primary section to the wires conductive core. The barbed portions associated with the primary section engage an adjacent wall of the respective receiving channel and lock that section to the base. The secondary sections are left in an angled configuration until such time as an interconnection with a second wire is to be made.

The second wire termination is made by placing a wire in a respective secondary wire support channel and pressing the respective movable secondary section downward allowing its associated legs to be inserted into respective receiving channels. The insertion may be made by using the end of a screwdriver or other similar pressure applying tool. At this time the edges of the associated slot-type termination devices slice through the insulation of the wire and electrically connects the secondary section to the wires conductive core. The barbed portions of the secondary section legs engage respective receiving channel walls and lock the legs in a fixed position parallel with the horizontal plane of the primary connecting section.

The terminal apparatus provides a unique configuration of terminal and base features which provide a quick connect terminal apparatus designed with movable sections that require only a pressure applying device such as a standard screwdriver to interconnect two or more wires together.

BRIEF DESCRIPTION OF THE DRAWINGS

A better understanding of the invention may be had from the consideration of the following detailed description taken in conjunction with the accompanying drawings in which.

PREFERRED EMBODIMENT OF THE INVENTION

Figure 1:
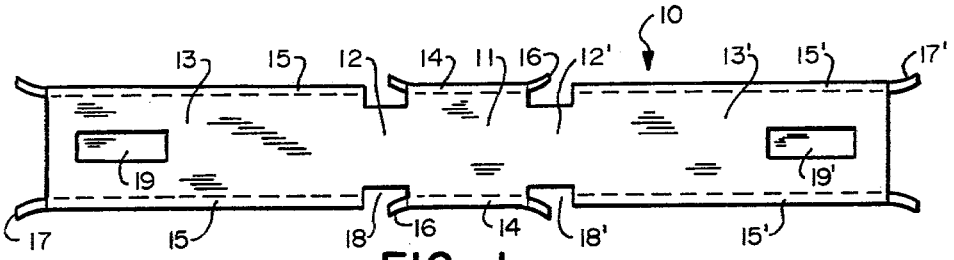
FIG. 1 is a top plane view of the interconnecting terminal including a primary connecting section, two hinge sections and two secondary connecting sections in accordance with the present invention described herein.

Referring now to the accompanying drawings of the present invention, FIG. 1 illustrates the interconnecting terminal shown generally as 10 of the present invention. The terminal is composed as a one piece unitary structure constructed of an electrically conductive material and is comprised of three sections; a primary connecting section 11, a hinge section 12 and a secondary connecting section 13. It should be noted that in this embodiment there are two secondary connecting sections and hinge sections and that the invention may be also used to advantage employing only one secondary connecting section and hinge section.

Figure 2:
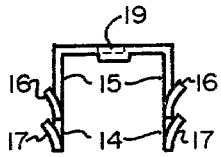
FIG. 2 is a side view of the interconnecting terminal showing the barbed primary connecting sections portions and the barbed secondary connecting sections portion.
Figure 3:
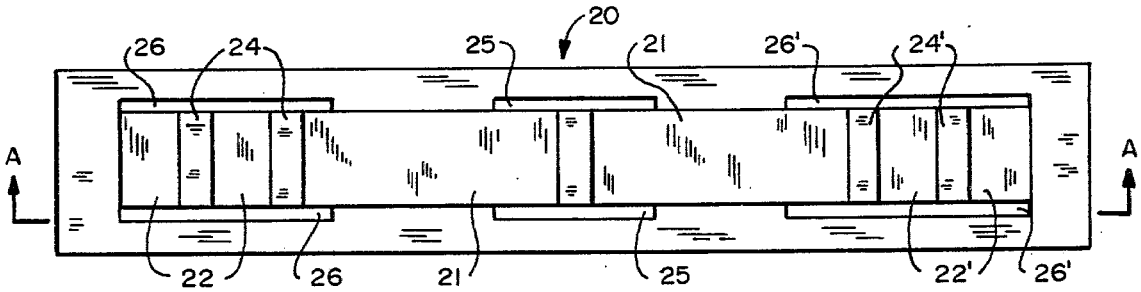
FIG. 3 is a top plane view of the insulated base in accordance with the present invention described herein.

Primary connecting section 11 and secondary connecting sections 13 and 13', also include perpendicular legs 14 and 15, 15' respectively. Legs 14 and 15, 15' are oriented downwardly from opposite edges of the primary connecting section and secondary connecting sections respectively allowing the interconnecting terminal to be generally U-shaped in cross section as shown on FIG. 2. Each of legs 14 and 15, 15' further include outwardly bent barbed portions such as those illustrated as 16 on the primary connecting section and 17, 17' on the secondary connecting section. The hinge sections 12, 12' include a pair of notches 18, 18' which define a relieved portion allowing the associated secondary connecting section to be easily pivoted from a first position to a second. The interconnecting terminal is manufactured with the secondary connecting sections 13, 13' in a first position, normally angularly displaced upward from the horizontal plane of the primary connecting section 11.

The interconnecting terminal is intended to be installed into a complementary terminal base 20 which is molded of a suitable insulated material. Base 20 includes two primary raised portions shown as 21 and secondary raised portions shown as 22, 22'. The raised portions are generally rectangular in shape and are oriented in away as to form a primary conductor receiving channel 23 and secondary conductor receiving channels 24, 24'. Each of the channels are of a height and width to allow placement of at least one insulated electrical conductor therein. The base further includes longitudinally oriented primary and secondary receiving channels. Each of the primary receiving channels 25 is adapted to receive a different leg of primary connecting section legs 14. Secondary receiving channels 26, 26' are also adapted to receive an individual leg of secondary connecting section legs 15, 15'. Each channel 25 and 26, 26' is of a depth greater than channels 23 and 24, 24'.

Figure 4:
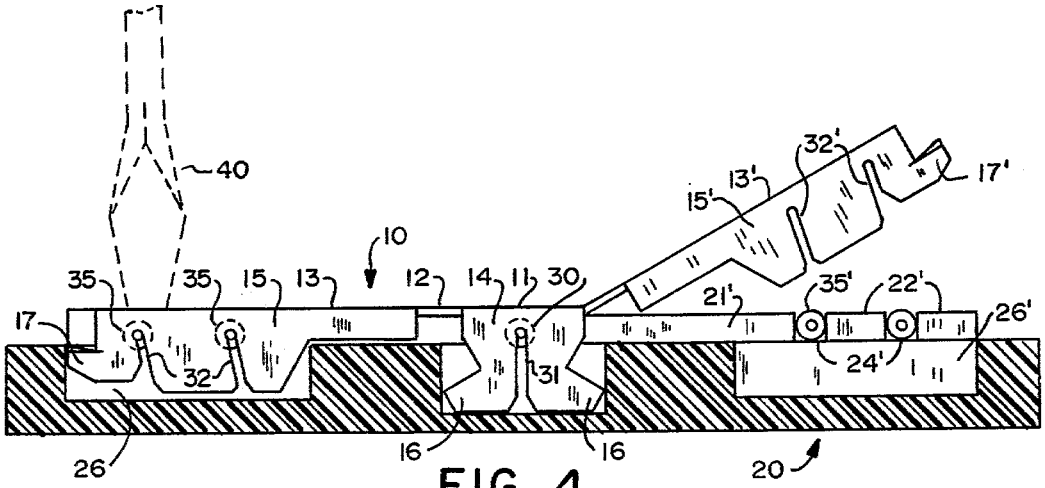
FIG. 4 is a sectional view showing the installation of the interconnecting terminal to the base taken substantially along line A—A on FIG. 3.

Referring now to FIG. 4 the installation of the interconnecting terminal 10 to base 20 is illustrated. A primary insulated electrical conductor 30 of a type which has an electrically conductive core surrounded by an insulated jacket is first placed within channel 23. Terminal 10 is then positioned above conductor 30, allowing each leg 14 to be inserted into respective receiving channels 25. Each leg 14 includes a slot-type terminal 31 which is adapted to slice thru conductors 30 insulated jacket and make contact with its conductive core. In this manner a first primary electrical connection is made. Barbed portions 16, due to their orientation deflect inward allowing each leg to be slidably inserted within the respective receiving channel 25 and upon full insertion engage a side wall of the channel thereby locking the primary section to the base.

To electrically interconnect the primary section to a secondary conductor a second insulated electrical conductor 35 is placed within one of the channels 24 and secondary connecting section 13 is urged downward to a second position by use of a screwdriver 40 or other similar instrument which is adapted to be accepted into cavities 19, 19' on the interconnecting terminal. As the secondary connecting section is urged downward a slot-type termination device 32 slices through the insulated jacket of conductor 35 and makes an electrical contact at the conductors core. Secondary connecting section 13 is locked to the base in the same manner as the primary connecting section using barbs 17, which finally positions the secondary connecting section parallel with the horizontal plane of the primary connecting section.

As shown in FIG. 4 the embodiment illustrates four secondary conductors which may be electrically interconnected to a primary conductor. It should be noted that a greater or lessor number of interconnections can be made and the only limitations being the provision of a like number of conductor receiving channels for a like number of slot-type connecting points.

The present invention has been described with reference to a specific embodiment thereof, for the purpose of illustrating the manner in which the invention may be used to advantage, and it will be appreciated by those skilled in the art that the invention is not limited thereto. Accordingly, any and all modifications, variations or equivalent arrangements which may occured to those skilled in the art should be considered to be within the scope of the invention.

What is claimed is:

1. A terminal apparatus for electrically interconnecting at least two insulated electrical conductors said conductors including an electrically conductive core surrounded by an insulated jacket, said terminal apparatus comprising:

a primary connecting section, U-shaped in cross-section and including a planar top surface and a pair of legs integrally joined on opposite edges of said top surface and oriented perpendicular to said top surface, each leg including an electrical conductor connective means, and said connective means in linear alignment with each other;

a secondary connecting section, U-shaped in cross-section and including a planar top surface and a pair of legs integrally joined on opposite edges of said top surface and oriented perpendicular to said top surface, each leg including an electrical conductor connective means, and said connective means in linear alignment with each other;

a hinge section mechanically and electrically joining said primary section and said secondary section, said secondary section normally disposed in a first position and adapted to be displaced into a second position;

an electrically insulated base comprising a primary connecting section receiving portion including a pair of receiving channels, and a secondary connecting portion including a pair of receiving channels, said primary receiving portion further including at least one insulated electrical conductor holding means and said secondary receiving portion further including at least one insulated electrical conductor holding means;

said primary receiving portion holding means adapted to receive at least one primary insulated electrical conductor therein and said secondary receiving portion holding means adapted to receive at least one secondary electrical conductor therein;

said primary connecting section initially interlockingly engaged to said primary receiving portion whereby each of said primary connecting section legs is inserted into a different one of said primary receiving channels, and each of said connective means intersects said primary holding channel and engages said primary insulated electrical conductor forming and electrical connection thereat, said secondary connecting section manually displaced to said second position after said primary connecting section initial engagement to interlockingly engage said secondary receiving portion whereby each of said secondary connecting section legs is inserted into a different one of said secondary receiving channels, and each of said connective means intersects said secondary holding channel and engages said secondary insulated electrical conductor to form an electrical connection thereat, thereby electrically interconnecting said primary and secondary electrical conductors.

2. A terminal apparatus as claimed in claim 1, wherein: said hinge section includes a planar top surface, said hinge top surface further including a pair of edges each edge having a transversely oriented notch therein, said notches in direct opposition of each other.

3. A terminal apparatus as claimed in claim 1, wherein: said electrical conductor connective means is comprised of a wire-receiving slot having a mouth on one end and extending to a closed opposite end, the width of said slot being less than the width of said insulated electrical conductor and adapted to penetrate said insulated jacket and engage said electrically conductive core.

4. A terminal apparatus as claimed in claim 1, wherein: said insulated base includes a top surface, and said primary receiving portion holding means includes first and second raised sections integrally joined to said base top surface, each raised section having a pair of longitudinally oriented edges and a pair of transverse edges, said first and second raised portions in juxtaposition along one respective transverse edge forming a holding channel therebetween, said holding channel of a width to allow placement of at least one of said primary insulated electrical conductors therein.

5. A terminal apparatus as claimed in claim 4, wherein: said secondary receiving portion holding means includes at least one additional raised section with a pair of transverse edges, one of said transverse edges in juxtaposition to an opposite transverse edge of said first raised portion forming a holding channel therebetween, said holding channel of a width to allow placement of at least one of said secondary insulated electrical conductors therein.

6. A terminal apparatus as claimed in claim 5, wherein: each of said pair of primary connecting section receiving channels include at least one channel wall, each longitudinally oriented along respective and opposite longitudinal edge portions of said first and second raised sections perpendicular to said primary holding channel, said pair of receiving channels of a depth greater than said primary holding channel.

7. A terminal apparatus as claimed in claim 6, wherein: each of said pair of primary connecting section legs include at least one outwardly bent barbed portion, each barbed portion adapted to engage a respective channel wall of each of said pair of primary receiving channels, when said primary connecting section legs are inserted within said primary receiving channels, locking said primary connecting section to said base.

8. A terminal apparatus as claimed in claim 5, wherein: each of said pair of secondary connecting section receiving channels include at least one channel wall, each longitudinally oriented along respective and opposite longitudinal edge portions of said first and said additional raised section perpendicular to said secondary holding channel, said pair of receiving channels of a depth greater than said secondary holding channel.

9. A terminal apparatus as claimed in claim 3, wherein: each of said pair of secondary connecting section legs include at least one outwardly bent barbed portion, each barbed portion adapted to engage a respective channel wall of each of said pair of secondary receiving channels when said secondary connecting section legs are inserted within said secondary receiving channels, locking said secondary connecting section to said base.

* * * * *

UNITED STATES PATENT AND TRADEMARK OFFICE

CERTIFICATE OF CORRECTION

PATENT NO. : 4,252,395

DATED : February 24, 1981

INVENTOR(S) : Ronald C. Ward and Richard B. Kosten

It is certified that error appears in the above-identified patent and that said Letters Patent are hereby corrected as shown below:

Column 6, line 41, "3" should be --8--

Signed and Sealed this

*Twenty-sixth* Day of *May 1981*

[SEAL]

*Attest:*

RENE D. TEGTMEYER

*Attesting Officer*

*Acting Commissioner of Patents and Trademarks*